US008038018B1

(12) United States Patent
Breitenbach et al.

(10) Patent No.: US 8,038,018 B1
(45) Date of Patent: Oct. 18, 2011

(54) VENDING MACHINE PRODUCT STABILIZER

(75) Inventors: Paul T. Breitenbach, Wilton, CT (US); Paul Signorelli, Ridgefield, CT (US); Matthew D. Breitenbach, Ridgefield, CT (US); Colin Marr, Seymour, CT (US); Igor Zhuk, Weston, CT (US); Daniel Signorelli, Wappinger Falls, NY (US)

(73) Assignee: Vendmore Systems, LLC, Stamford, CT (US)

( * ) Notice: Subject to any disclaimer, the term of this patent is extended or adjusted under 35 U.S.C. 154(b) by 1 day.

(21) Appl. No.: 12/410,346

(22) Filed: Mar. 24, 2009

Related U.S. Application Data

(60) Provisional application No. 61/039,138, filed on Mar. 25, 2008.

(51) Int. Cl.
*A47F 1/04* (2006.01)

(52) U.S. Cl. ..... 211/59.3; 221/123

(58) Field of Classification Search ..... 211/59.2, 211/59.3, 184, 120; 221/74, 75, 123, 124, 221/312 R, 261, 81, 83
See application file for complete search history.

(56) References Cited

U.S. PATENT DOCUMENTS

| | | | | |
|---|---|---|---|---|
| 2,732,952 | A * | 1/1956 | Skelton | 211/59.3 |
| 3,773,217 | A * | 11/1973 | Schlaf | 221/75 |
| 3,893,739 | A * | 7/1975 | Bernard | 312/321.5 |
| 4,061,245 | A * | 12/1977 | Lotspeich | 221/75 |
| 4,200,201 | A * | 4/1980 | Collins et al. | 221/129 |
| 4,369,896 | A * | 1/1983 | Boettcher | 221/75 |
| 4,423,828 | A * | 1/1984 | Tanaka et al. | 221/129 |
| 4,930,663 | A * | 6/1990 | Ficken | 221/75 |
| 5,497,905 | A * | 3/1996 | Vogelpohl et al. | 221/226 |
| 6,129,218 | A * | 10/2000 | Henry et al. | 211/59.3 |
| 6,571,988 | B2 * | 6/2003 | Bowen | 221/274 |
| 2005/0067426 | A1 * | 3/2005 | Holdway et al. | 221/123 |
| 2005/0127014 | A1 * | 6/2005 | Richter et al. | 211/59.2 |
| 2005/0252925 | A1 * | 11/2005 | Kelly | 221/92 |
| 2006/0273104 | A1 * | 12/2006 | Zychinski | 221/123 |
| 2007/0084875 | A1 * | 4/2007 | Percy | 221/258 |
| 2008/0099496 | A1 * | 5/2008 | Black et al. | 221/13 |

* cited by examiner

*Primary Examiner* — Darnell Jayne
*Assistant Examiner* — Patrick Hawn
(74) *Attorney, Agent, or Firm* — Taylor M. Davenport; Withrow & Terranova, PLLC

(57) ABSTRACT

A vending machine has one or more resilient members placed in each row from which products are vended. As product moves through the row, the product abuts against the resilient member and is forced into an upright and aesthetically pleasing orientation. Further forward movement forces the resilient member out of the path of the product's movement.

12 Claims, 8 Drawing Sheets

VENDING MACHINE PRODUCT STABILIZER

RELATED APPLICATIONS

The present application claims the benefit of U.S. Provisional Patent Application No. 61/039,138, filed Mar. 25, 2008 in the name of Breitenbach et al. entitled System, Method, and Apparatus for vending machine disclosures including: inventory auto-planogram, wireless mobile drink system, energysmart energy reduction systems, vending operator account portal, consumer account portal and dispending systems and hardware modifications. This application is incorporated herein by reference in its entirety.

FIELD OF THE INVENTION

The present disclosure is directed to a vending machine and more particularly to a technique that allows soft-packaged product within the vending machine to be presented in a more aesthetically pleasing manner.

BACKGROUND

Vending machines ubiquitously decorate the daily lives of many people. Early machines had an opaque face usually emblazoned with a company or product logo. The opaque face allowed (and continues to allow for those machines so equipped) the product to be stacked in a manner that lacks aesthetic appeal. The advent of vending machines with a transparent front required operators to arrange the product in a manner that provided some aesthetic appeal. While some vending machines use tilted shelves to provide for gravity feed vending, more commonly used dispensing mechanisms include a spiral feed mechanism or a push plate mechanism. All three mechanisms allow for ready viewing of the entire row of the product by a prospective customer. However, because the mechanisms have to be sized for the largest item to be vended, the mechanisms lend themselves to additional aesthetic concerns. For example, product that leans or has folded may create the impression that the product may not vend properly. This appearance may lead the customer to make a different purchase or forego a purchase. The popularity of bottled water with its ever changing packaging has exacerbated the need for vending machines which support the product to provide the desired aesthetic appearance. Spiral column dispensers and push plate dispensers are not well suited for dispensing the contemporaneous generation of soft packaged products. Rather than replace the vending machines with dispensing mechanisms adapted to accommodate the current packaging styles, a need exists for an improvement which allows product to be presented in an aesthetically pleasing manner and diminishes the likelihood of misvended product.

DETAILED DESCRIPTION

The present disclosure addresses some of the shortcomings explained above as well as addresses other issues by adding one or more resilient stabilizers to the rows from which the product is vended. The resilient members urge the product packaging into a desired orientation or prevent the product packaging from falling into an orientation that is aesthetically unattractive or might cause the product to be misvended. In an exemplary embodiment, the resilient member is spring loaded and abuts the product as it urges the product into the desired orientation. In another embodiment, a plate positioned behind the product may be used to help support the product in a desired orientation.

Figure 1:
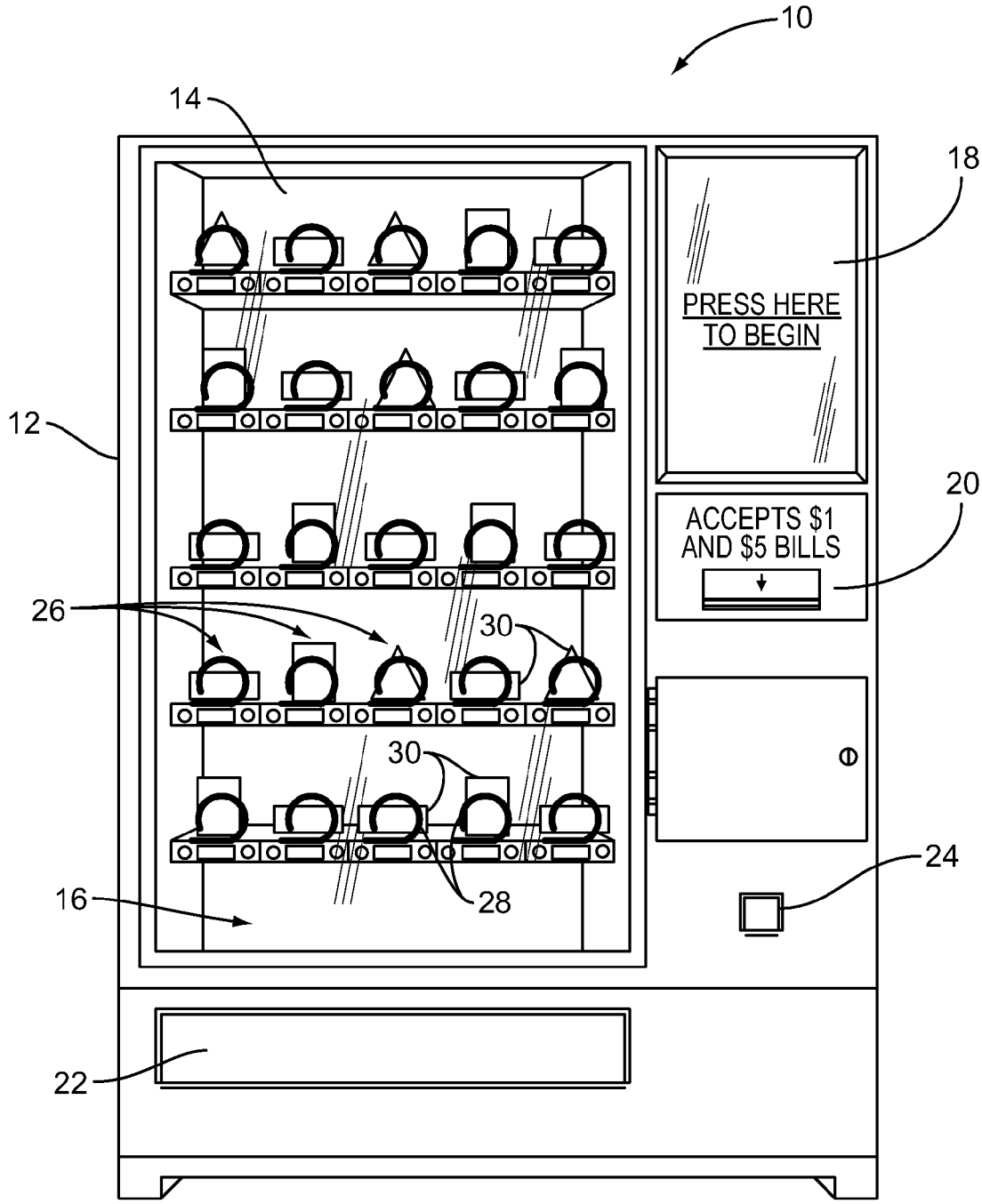
FIG. 1 PRIOR ART
FIG. 1 illustrates an exemplary embodiment of a conventional glass-faced vending machine.

By way of further explanation, FIG. 1 illustrates a conventional vending machine 10 with cabinet 12 having a transparent front 14 made out of glass or transparent polymeric material. A customer may view an interior cabinet 16 through the front 14. The vending machine 10 may further have a user interface 18 that comprises a touchscreen or comparable input/output device as is well understood. The vending machine 10 may further include a cash acceptor 20 through which the user may pay for product as is well understood and a hopper 22 through the user may retrieve vended product, again as is well understood. If the user is owed change from part of a transaction, the change may be dispensed through a change return slot 24.

Within the interior cabinet 16, a plurality of rows 26 may be arranged in shelves. As illustrated, FIG. 1 includes a spiral feed mechanism 28 in which product 30 is placed and through which the product 30 dispensed.

Figure 2:
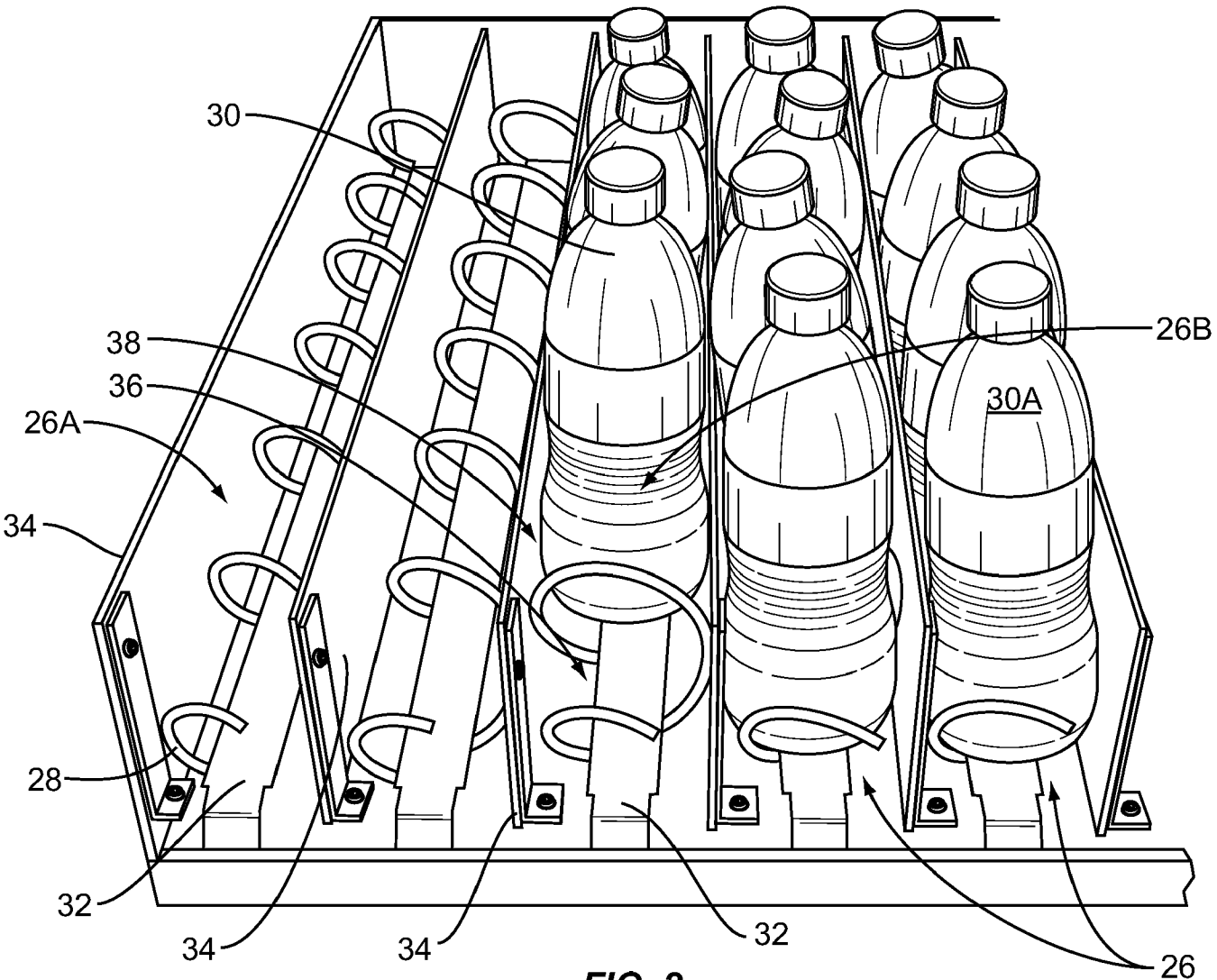
FIG. 2 PRIOR ART
FIG. 2 illustrates an exemplary embodiment of a row within a conventional spiral feed vending machine with product misaligned within the row.

FIG. 2 illustrates a plurality of rows 26 on a single shelf within a spiral feed style vending machine 10. Rows 26 may be divided one from another by dividers 34. In particular, a first row 26A is empty and the row illustrates a base plate 32 and the spiral mechanism 28. Conceptually, the spiral mechanism 28 may be divided into slots in which product 30 rests. That is, there is a first slot 36 which is closest to the front 14 and which is the slot where product 30 is most readily visible to the customer (see row 26B). Likewise, there is a second slot 38 which is one slot removed from the first slot 36 (i.e., behind first slot 36). If a product 30A is tilted or folds (e.g., a bag of chips), a prospective customer may fear that the product will not vend correctly (a "misvend") and not purchase the product. One of the reasons that the product 30A may be misaligned is that a row 26 is sized to accommodate a number of different products including some which may be relatively wide compared to others (e.g., a bag of chips compared to a bottle of water). This sizing means that the rows may be too wide for some products, allowing lateral movement of the product. This lateral movement may allow the product to fold, tip or otherwise be misaligned.

Figure 3:
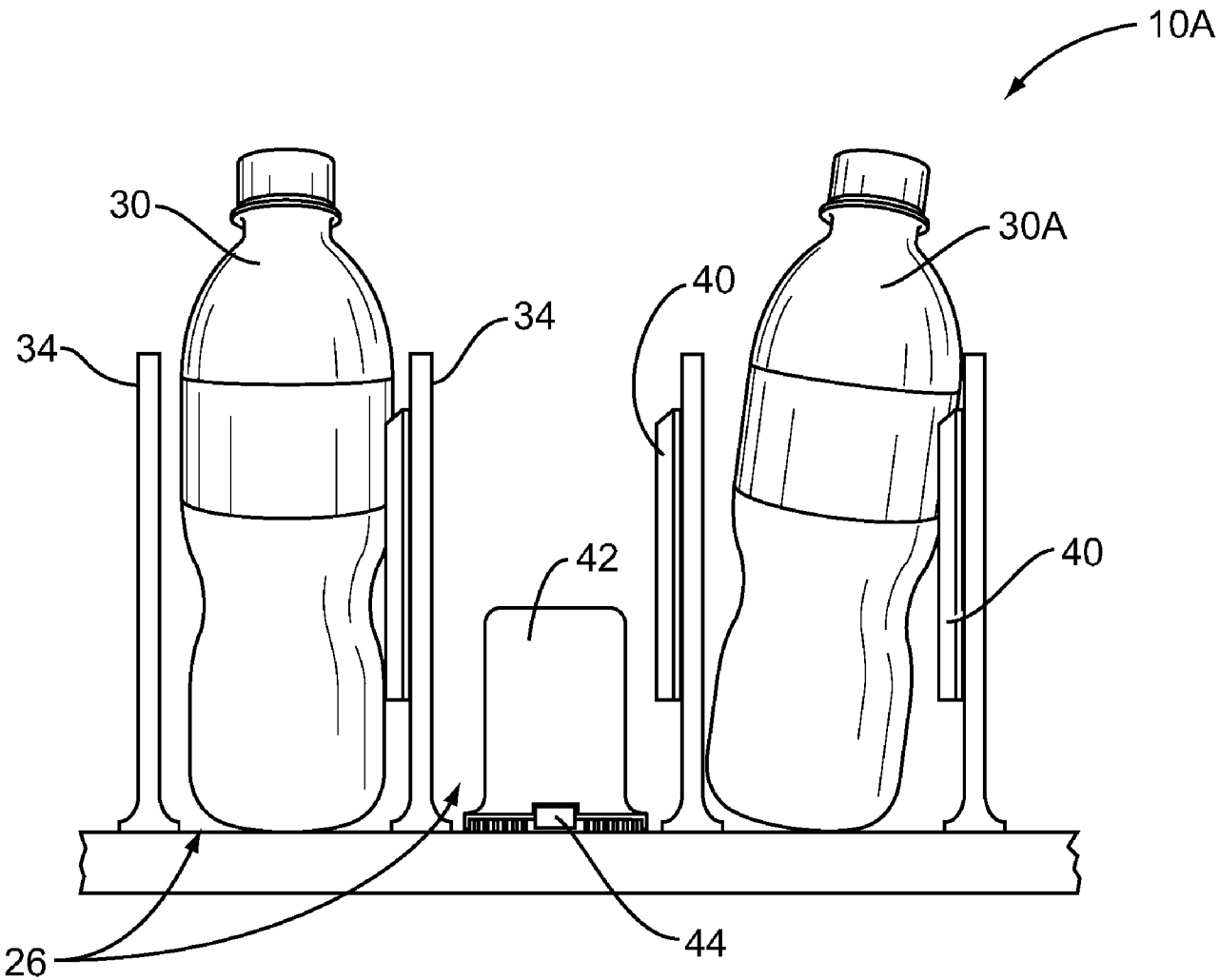
FIG. 3 PRIOR ART
FIG. 3 illustrates an exemplary embodiment of a row within a conventional push plate vending machine with product misaligned within the row.

FIG. 3 illustrates a conventional push plate dispensing mechanism in a few rows 26 of the vending machine 10A. As illustrated, each row 26 includes a push plate 42 attached to a base 44. The base 44 is driven by a motive force such as a motor, a magnet, or the like. When the command to vend a product is received, the motive force advances the push plate 42 towards the front 14 of the vending machine 10A, pushing the product past a stationary, rigid wedge 40 as is well understood. Again, because the rows may be too wide, product 30A may tilt, fold, or otherwise be improperly positioned within the row such that a customer may fear a misvend.

While the present disclosure only illustrates a spiral feed mechanism and a push plate feed mechanism, it should be appreciated that vending machines equipped with gravity feed mechanisms or other product advancement tools may also benefit from using the inventive concepts of the present disclosure.

The present disclosure provides a solution to this problem in the form of a resilient member positioned proximate a front end of each row. In a first embodiment, illustrated in FIGS. 4-6, the resilient member 46 is a spring loaded hinged arm. Specifically, the resilient member 46 includes a first arm 48 that has a first end that is folded back to form a clip 50. Adhesive or foam pads may be provided on interior surfaces of the clip 50 to help the clip 50 attach to the dividers 34. The first arm 48 further includes a hinge end (not labeled) opposite the clip 50 that attaches to and/or forms part of a hinge 52. The resilient member 46 further includes a second arm 54 having a first straight portion 56 that has a hinge end (not labeled) that also attaches to and/or forms a part of the hinge 52 and a distal end (not labeled). The distal end of the straight portion 56 is attached to or integrally formed with a second arcuate portion 58 that is curved so as to accommodate a beverage container such as cans, bottles or other curved objects, such as product 30 (illustrated as a can). A spring 60 is coupled to the hinge 52 so as to provide resilience to the resilient member 46. As better illustrated in FIG. 5, the spring 60 biases the second arm 54 open and against the direction of product flow (illustrated by arrow 62) as the products 30 are vended.

While the first arm 48 is illustrated as being about half the length of second arm 54, other ratios are contemplated. Likewise it is possible that the entire length of the first arm 48 forms part of the clip 50 rather than merely a portion.

Figure 4:
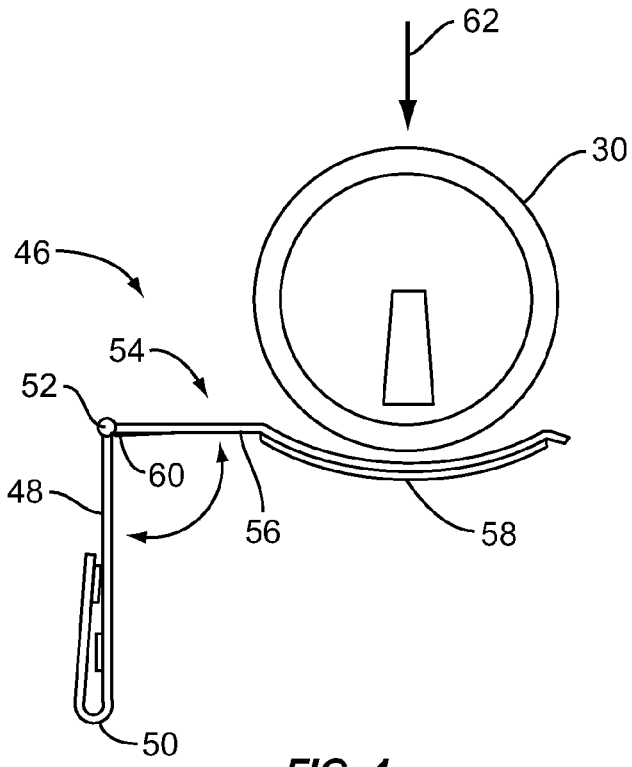
FIG. 4 illustrates a top view of a first embodiment of a stabilizer with a product abutting thereagainst.
Figure 5:
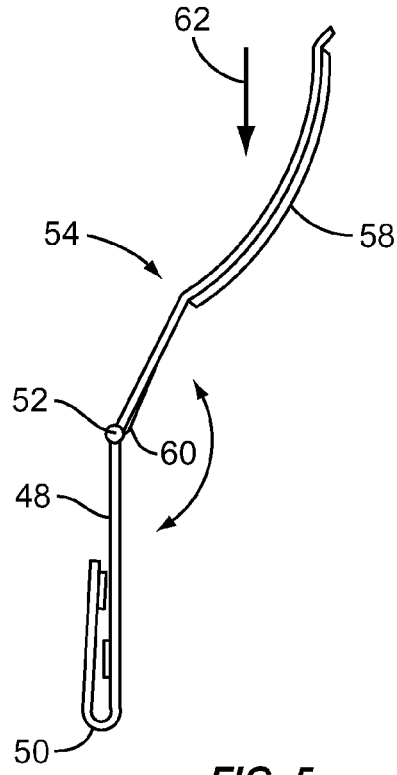
FIG. 5 illustrates a top view of the first embodiment without a product.
Figure 6:
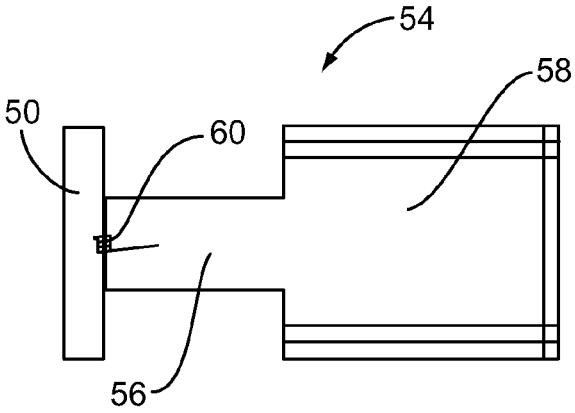
FIG. 6 illustrates a front elevational view of the first embodiment.

The resilient member 46 of FIGS. 4-6 as well as other resilient members described herein may be made of any suitable material such as a metal or polymeric material. In a particularly contemplated embodiment, the resilient members are made from a clear polymeric material.

Figure 7:
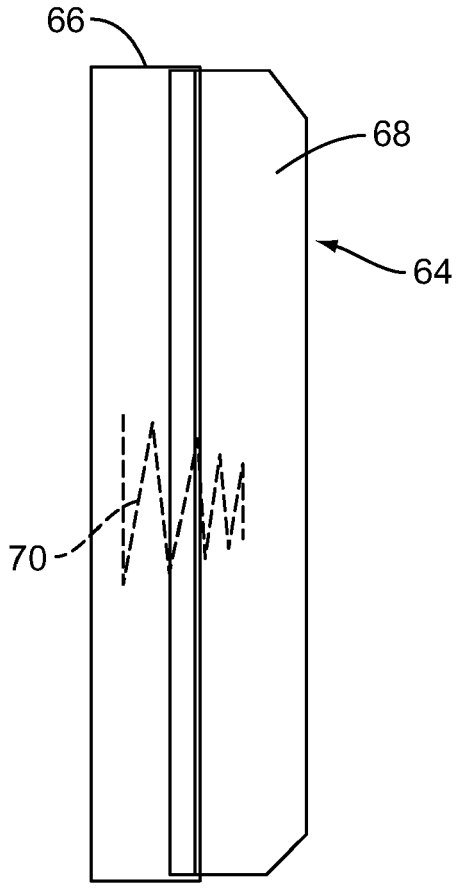
FIG. 7 illustrates a front elevational view of a second embodiment of a stabilizer.
Figure 8:
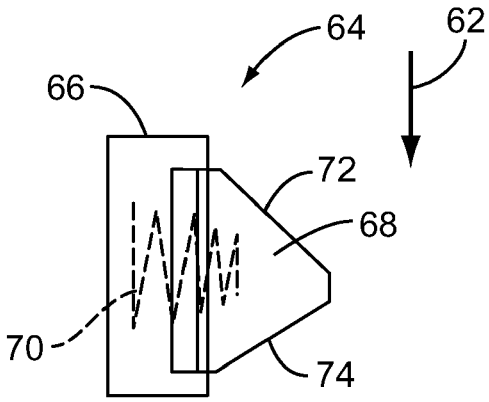
FIG. 8 illustrates a top view of the second embodiment.

In a second embodiment, illustrated in FIGS. 7 & 8, a resilient member 64 is formed by a base 66 coupled to a trapezoidal sliding member 68. The trapezoidal sliding member 68 is biased outwards by a spring 70 into the path of a product 30 being vended along direction of product flow 62. The trapezoidal sliding member 68 includes a first slanted surface 72 which is adapted to abut a product 30 and a second slanted surface 74. Note that advertising, promotional or instructional indicia may be readily displayed on the second slanted surface 74. As the product 30 is advanced towards the front 14 of the vending machine, the product 30 pushes against the first slanted surface 72, compressing the spring 70, and clearing the path of the product 30. As the product 30 pushes past the resilient member 64, the spring 70 pushes the trapezoidal sliding member 68 outwardly back into the path of the next product 30.

Figure 9:
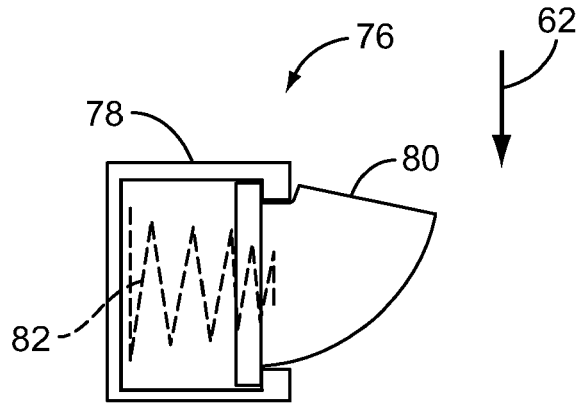
FIG. 9 illustrates a top view of a third embodiment of a stabilizer.

A third embodiment is illustrated in FIG. 9 with resilient member 76. Resilient member 76 includes a base 78 and a moving arm 80. Arm 80 is biased outwardly by a spring 82. The base 78 is generally cup shaped to hold the spring 82. The moving arm 80 extends laterally out into the path of a product 30 being vended along direction of product flow 62.

Figure 10:
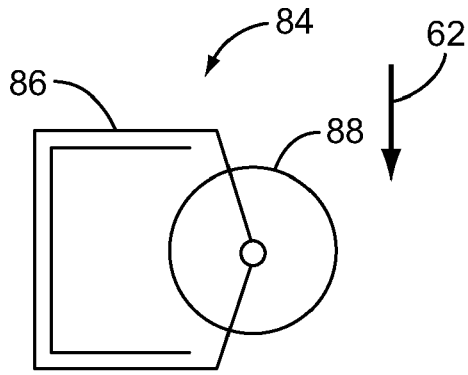
FIG. 10 illustrates a top view of a fourth embodiment of the stabilizer.

A fourth embodiment is illustrated in FIG. 10 with resilient member 84. Resilient member 84 includes a base 86 and a spring wheel 88. The base 86 is generally cup shaped, and the spring wheel 88 is biased outwardly into the path of a product 30 being vended along direction of product flow 62.

Each of the resilient members described herein is designed to extend laterally into path of the product flow 62. By doing so, the product 30 is pushed against (i.e., abuts) the resilient member. By forcing the product against the resilient member, the product 30 is held in an orientation that meets the aesthetic needs of the vendor. That is, the product is upright, not tilted, and appears that it will vend properly. Likewise, the resilient nature of the resilient member means that as product is pushed past the resilient member by the movement of the spiral arm or the push plate, the resilient member will slide out of the way, allowing the product to advance past the resilient member.

Figure 11:
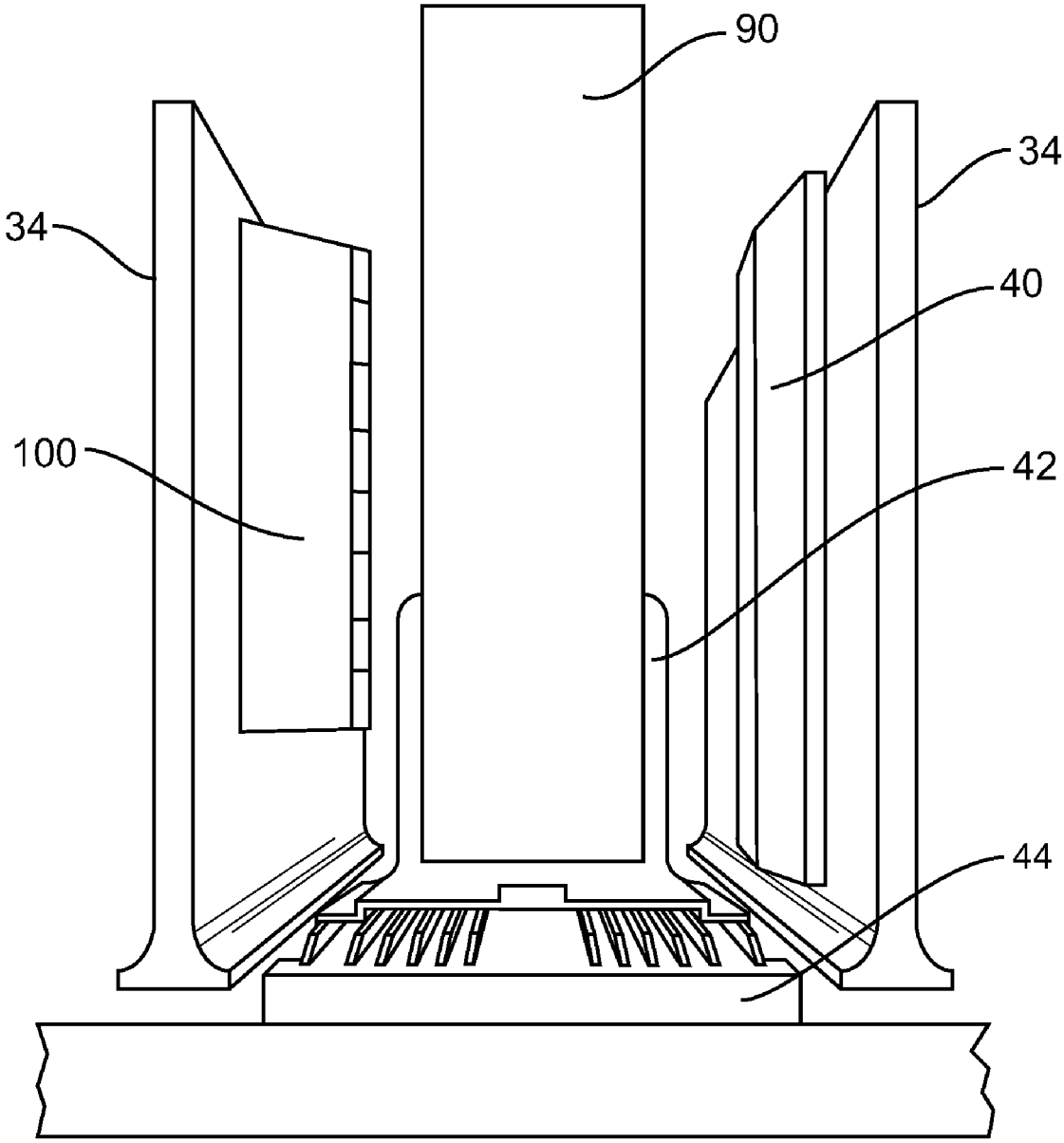
FIG. 11 illustrates a vertical support that may be used with a push drive vending machine.

FIG. 11 illustrates a supplemental device that helps support products 30 in a desired orientation. Specifically, for a push plate style vending mechanism, an extended plate 90 may be secured to the push plate 42 that extends above the height of the dividers 34 and may, in an exemplary embodiment, be approximately the height of a twenty ounce or pint sized bottle of water. Other heights are also contemplated and are within the scope of the present disclosure.

Figure 12:
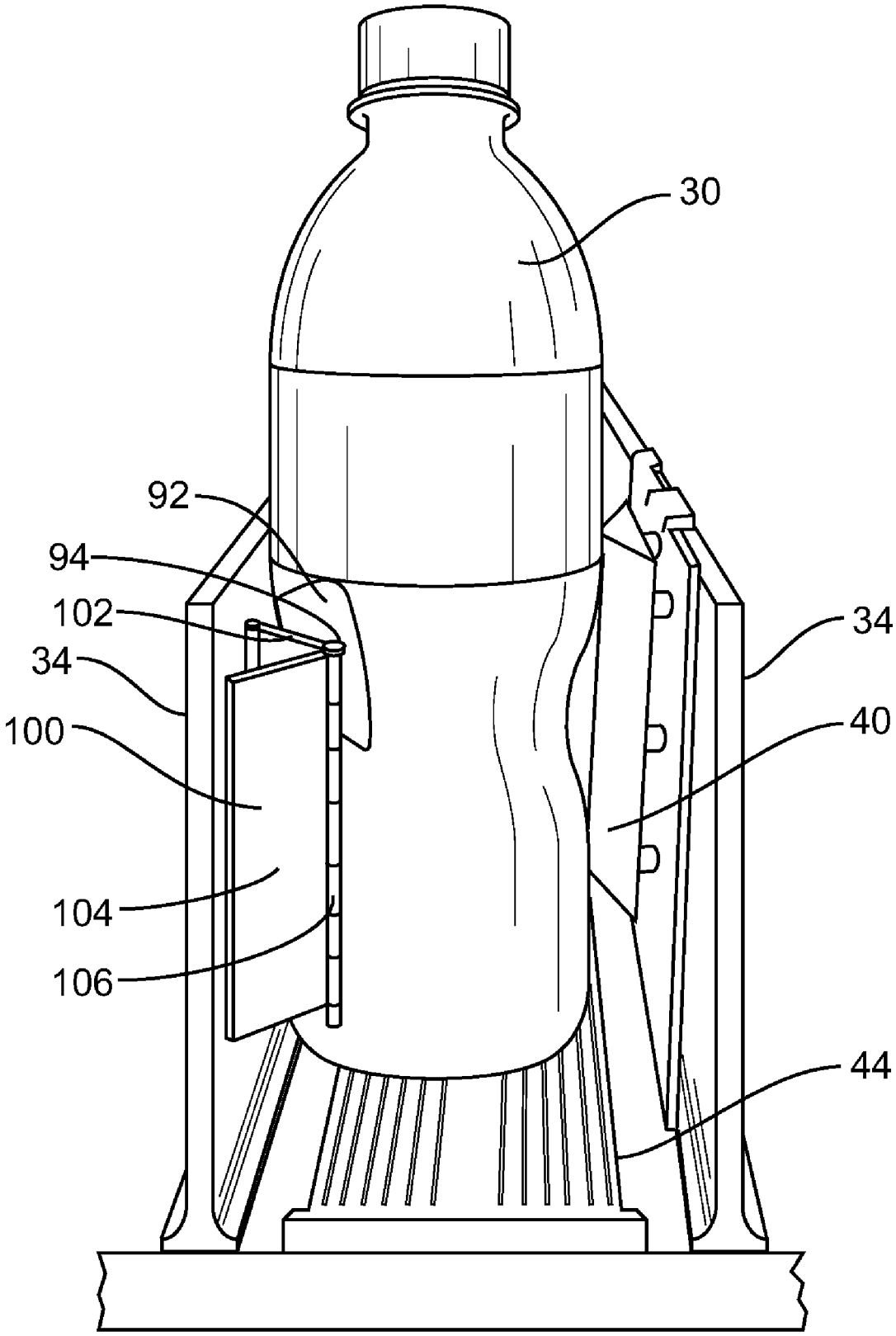
FIG. 12 illustrates a front elevational view of a shield that may be used with one or more embodiments of the present disclosure.

FIG. 12 illustrates another supplemental device that helps prevent deformation of the packaging of the product 30. In particular, a flexible shield 92 may be positioned between the product 30 and an upper corner 94 of the resilient member 100. Thus, the sharp edge of the upper corner 94 does not poke into the thin walled (e.g., flexible) packaging and allows the packaging to maintain its original shape when the packaging abuts the resilient member 100. Note that resilient member 100 represents another embodiment of the resilient member. The resilient member 100 includes a first surface 102 that abuts the product 30 and a second surface 104. A spring hinge 106 connects the first surface 102 to the second surface 104 and biases the resilient member 100 into a generally triangular shape. As the product 30 is advanced, the spring spreads, pushing the second surface 104 into a generally parallel relation to the first surface 102 such that the product 30 may pass through. After the product 30 has passed the hinge 106, the spring hinge 106 contracts, drawing the resilient member 100 back into its generally triangular shape.

Figure 13:
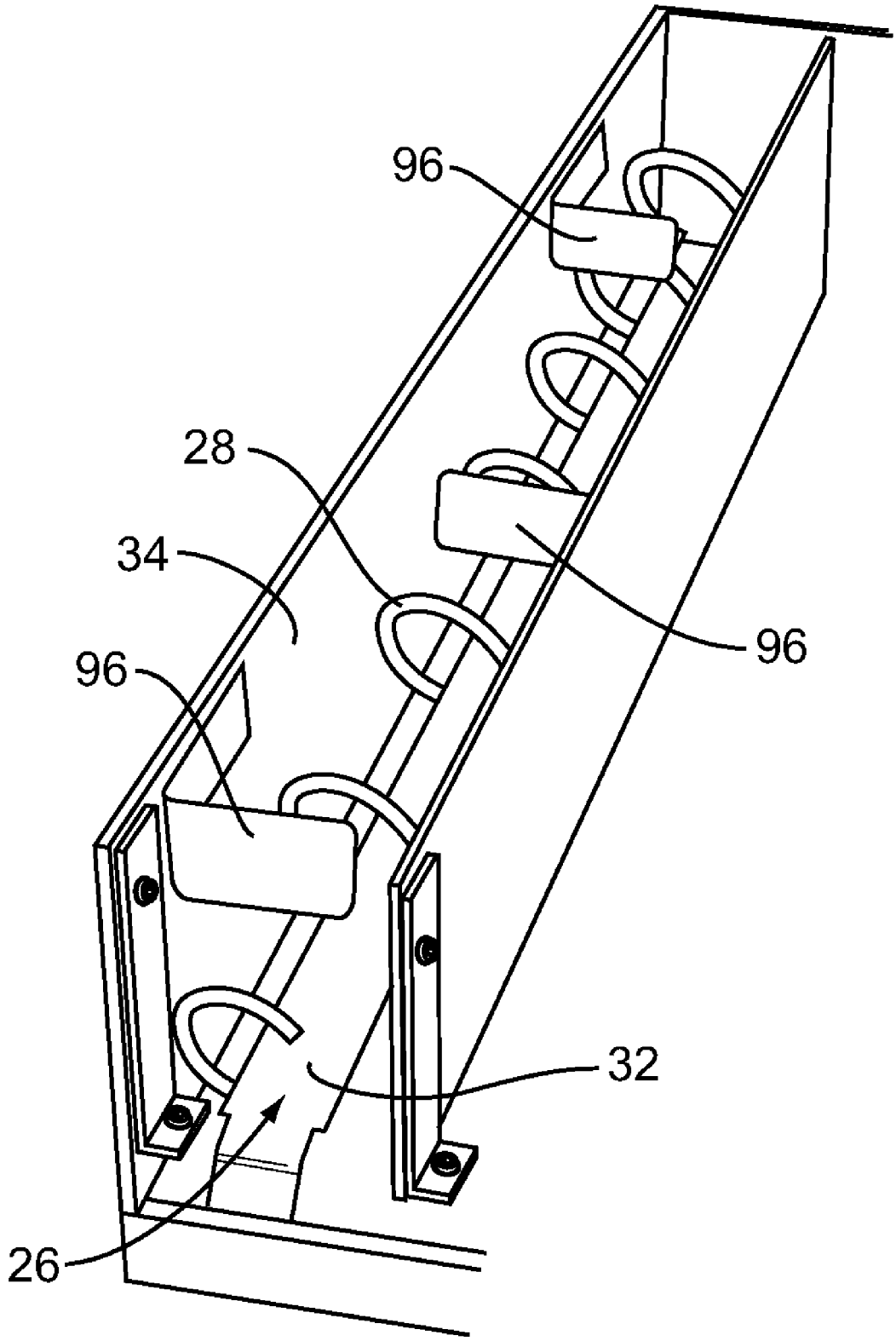
FIG. 13 illustrates a row of a spiral feed vending machine with a fourth embodiment of a stabilizer.

While it is contemplated that the resilient members may be positioned proximate the front of a given row 26, it is possible that a plurality of resilient members may be used at different points along a given row 26. For example, as illustrated in FIG. 13, a plurality of resilient members 96 may be positioned along the dividers 34. As illustrated, the resilient members 96 alternate on which sides they are positioned, although such is not required. Likewise, the resilient members 96 are another embodiment wherein the resilient member 96 comprises a single plastic or acrylic "L" shaped gate or flop. The material of the resilient member 96 is strong enough to hold a can upright when a can abuts the resilient member 96.

While particular embodiments have been disclosed herein for particular types of vending machines, it should be appreciated that variations in the material, shape and size of the resilient member as well as differences between types of vending machines may be accommodated without departing from the scope of the present disclosure.

What is claimed is:

1. A vending machine comprising:

a shelf divided into at least two rows separated by a divider;

a product advancement tool associated with a first row of the at least two rows, wherein the product advancement tool is adapted to move product forward in response to a vend command from a customer; and a resilient member, distinct from the product advancement tool and associated with the first row and adapted to abut product positioned in the first row so as to urge product into an upright position, wherein the resilient member comprises a first vertical surface and a second vertical surface hingedly connected to one another, wherein the first vertical surface is adapted to abut the product, and wherein the first vertical surface and the second vertical surface are connected through a spring hinge and form a triangle shape in a rest position, but flatten to allow passage of product as product is vended, and wherein as product is pushed past the resilient member by force exerted by the product advancement tool, the resilient member slides out of the way as a function of movement of the product, allowing the product to advance past the resilient member, and the resilient member returns to a default position after passage of the product.

2. The vending machine of claim 1 wherein the product advancement tool comprises a spiral vending mechanism.

3. The vending machine of claim 1 wherein the product advancement tool comprises a push plate mechanism.

4. The vending machine of claim 1 wherein the resilient member comprises a spring loaded resilient member.

5. The vending machine of claim 1 further comprising a resilient shield proximate the resilient member and adapted to prevent direct contact between a corner of the resilient member and product.

6. The vending machine of claim 5 wherein the resilient shield is positioned on an upper corner of the resilient member.

7. The vending machine of claim 6 wherein the resilient shield is adapted to cushion the upper corner of the resilient member so that the upper corner does not deform the product.

8. A vending machine comprising:

a shelf divided into at least two rows separated by a divider;

a product advancement tool associated with a first row of the at least two rows, wherein the product advancement tool is adapted to move product forward in response to a vend command from a customer; and a spring-hinged deformable resilient member, distinct from the product advancement tool and associated with the first row and adapted to abut product positioned in the first row so as to urge product into an upright position, wherein the resilient member comprises a first generally triangular shape in a normal position and a second flattened shape as product is advanced past the resilient member, and wherein as product is pushed past the resilient member by force exerted by the product advancement tool, the resilient member slides out of the way to the second flattened shape as a function of movement of the product, allowing the product to advance past the resilient member, and the resilient member returns to the first generally triangular shape after passage of the product.

9. The vending machine of claim 8 wherein the product advancement tool comprises an upright pusher plate.

10. The vending machine of claim 8 wherein the resilient member comprises a first vertical surface and a second vertical surface, wherein the first vertical surface is adapted to abut the product.

11. The vending machine of claim 1 wherein the resilient member moves from the default position to a flattened position solely as a function of product passage and returns to the default position after product passage solely as a function of a spring element.

12. The vending machine of claim 8 wherein the resilient member moves from the first generally triangular shape to a flattened shape solely as a function of product passage and returns to the first generally triangular shape after product passage solely as a function of the spring-hinged deformable resilient member.

* * * * *